United States Patent [19]

Baur et al.

[11] Patent Number: 4,821,552

[45] Date of Patent: Apr. 18, 1989

[54] DRAWING MECHANISM FOR A PRESS

[75] Inventors: Siegfried Baur; Rudi Brandstetter, both of Goeppingen; Gerhard Roos, Ebersbach-Bünzwangen, all of Fed. Rep. of Germany

[73] Assignee: L. Schuler, GmbH, Goeppingen, Fed. Rep. of Germany

[21] Appl. No.: 125,924

[22] Filed: Nov. 30, 1987

[30] Foreign Application Priority Data

Nov. 28, 1986 [DE] Fed. Rep. of Germany ..... 3640787

[51] Int. Cl.[4] ..... B21D 45/04; B21D 22/00

[52] U.S. Cl. ..... 72/351; 72/345; 72/453.13; 267/119

[58] Field of Search ..... 72/347, 351, 453.13, 72/345; 267/119

[56] References Cited

U.S. PATENT DOCUMENTS

| | | | |
|---|---|---|---|
| 3,085,530 | 4/1963 | Williamson | 72/453.13 |
| 3,456,478 | 7/1969 | Alexander | 72/351 |
| 3,636,749 | 1/1972 | Heiser | 72/351 |
| 4,499,750 | 2/1985 | Gerber et al. | 72/351 |

FOREIGN PATENT DOCUMENTS

| | | | |
|---|---|---|---|
| 0074421 | 9/1981 | European Pat. Off. | 72/453.13 |
| 3619109 | 5/1987 | Fed. Rep. of Germany | 72/453.13 |

*Primary Examiner*—Robert L. Spruill
*Attorney, Agent, or Firm*—Barnes & Thornburg

[57] ABSTRACT

A drawing installation for a press which must produce the holding force during the drawing operation. The drawing ram displaces the sheet metal part and the sheet metal holder against the holding force and additionally must overcome at the beginning of the sheet metal deformation the inertia forces of the accelerated parts of the drawing installation. In order to avoid the forces which occur thereby in an impact-like manner, the piston rods transmitting the holding force and the ejector piston rods are pre-accelerated prior to the drawing ram. The piston rods each include an operating surface adapted to be acted upon in the drawing direction. The pressure spaces coordinated thereto are connected with a pressure quantity space each of a pre-acceleration cylinder and by way of a refill control with a pressure source. The control of the pre-acceleration cylinder and of the refill from the pressure source takes place in dependence on the movement of the drawing ram. The drawing installation can be used in presses with mechanically driven drawing rams and sheet metal holders retaining the sheet metal part whereby the functions of holding and ejection are carried out by separate pressure cylinders.

6 Claims, 1 Drawing Sheet

DRAWING MECHANISM FOR A PRESS

BACKGROUND AND SUMMARY OF THE INVENTION

The present invention relates to a drawing mechanism for a press equipped with a mechanically actuated drawing ram and with a sheet metal holder, with pressure cylinders for holding the sheet metal part during the drawing operation and with at least one pressure cylinder for the ejection of the workpiece and with a pressure plate adapted to be moved in a press table by the piston rods of the pressure cylinders and transmitting the movement and forces of the pressure cylinders by way of pressure rods to the sheet metal holder.

In order to prevent that the pressure plate is a press equipped with a drawing mechanism follows directly the drawing ram after the deformation, different pressure cylinder systems are provided for the ejection of the workpiece and the retention of the workpiece during the drawing which engage in different areas at the pressure plate.

Such a drawing installation is described in the DE No. 35 05 984. The different individual functions of the drawing mechanism such as control of the sheet metal holder pressure, control of the sheet metal holder upward movement, control of the ejector movement and of the end position abutment are adjustable and controllable independently of one another. The drawing installation includes pressure cylinders for the sheet metal retention during the drawing operation and pressure cylinders for the ejection of the workpiece as well as a pressure plate guided in the press table and movable and supported by the pressure cylinders. After the working stroke of the drawing ram, follow-up control systems become operable for an upward movement, independent in time, of the ejector- and drawing-piston rods. The drawing piston rods are disengageable for that purpose from the bottom side of the pressure plate.

During the working stroke of the drawing ram of the press, at first the sheet metal part inserted into the work tool is pressed by the drawing ring against the sheet metal holder and thereafter is displaced together with the sheet metal holder against the holding force produced by the drawing installation. In addition to the holding force to be supplied by the drawing mechanism, the drawing ram must also overcome the inertia forces which become effective at the beginning of the deformation as a result of the acceleration of the movable masses of the sheet metal holder and of the drawing mechanism.

For avoiding this load, which occurs impact-like on the drawing ram, it is known in connection with the drawing installation according to the EP No. 0 074 421 A1 to displace the several pressure rods for the pressure plate carrying the sheet metal holder by way of a piston rod, adapted to be actuated by a pressure medium, of a pressure cylinder fixed in the press. The piston rod is operatively connected with a pressure piston which has an operating surface adapted to be acted upon in the drawing direction. The operating surface is adapted to be acted upon directly from a pressure reservoir by way of a control system operating in dependence on ram travel so that the sheet metal holder is adapted to be pre-accelerated in the drawing direction prior to the touchdown of the drawing ram on the sheet metal holder. The movement of the piston rod of the drawing mechanism is controlled in time during the pre-acceleration phase and provides no indication of a pre-acceleration of separately arranged and operating drawing and ejector pistons.

In contrast thereto, it is the object of the present invention to control the pre-acceleration of the piston rods for the sheet metal holder pressure and the ejection operation in the drawing direction by way of deliberately predetermined metered quantities in hydraulic liquid and to control the refill in hydraulic liquid from a reservoir during the further movement of the piston rods in the drawing direction.

The underlying problems are solved according to the present invention in that each piston rod includes a pressure piston with an operating surface adapted to be acted upon in the drawing direction, in that each of the pressure spaces coordinated to an operating surface is in fluid communication, on the one hand, with a pressure quantity space of a pre-acceleration cylinder consisting of pressure quantity space, pressure space and a pressure piston separating these spaces from one another, and in that the, respectively, each pressure space is adapted to be pressure-actuated by a control system operating as a function of ram travel by way of a throttling directional control valve, whereby prior to the contact of the drawing ram on the sheet metal holder, the latter is adapted to be preaccelerated in the drawing direction by actuation of the operating surfaces with hydraulic liquid from the pressure quantity spaces.

Of particular advantage is thereby the quantitative control of the pre-acceleration of the piston rods in the drawing direction and the pre-control adapted to be influenced by way of a directional control valve variable in cross section by way of a pre-acceleration cylinder. The synchronous pre-acceleration is assured by the separation of the pressure spaces from one another. Pressure vibrations between the sheet metal part and the sheet metal holder are precluded. The sheet metal part is retained uniformly already during the beginning of the drawing phase.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figures 1, 2:
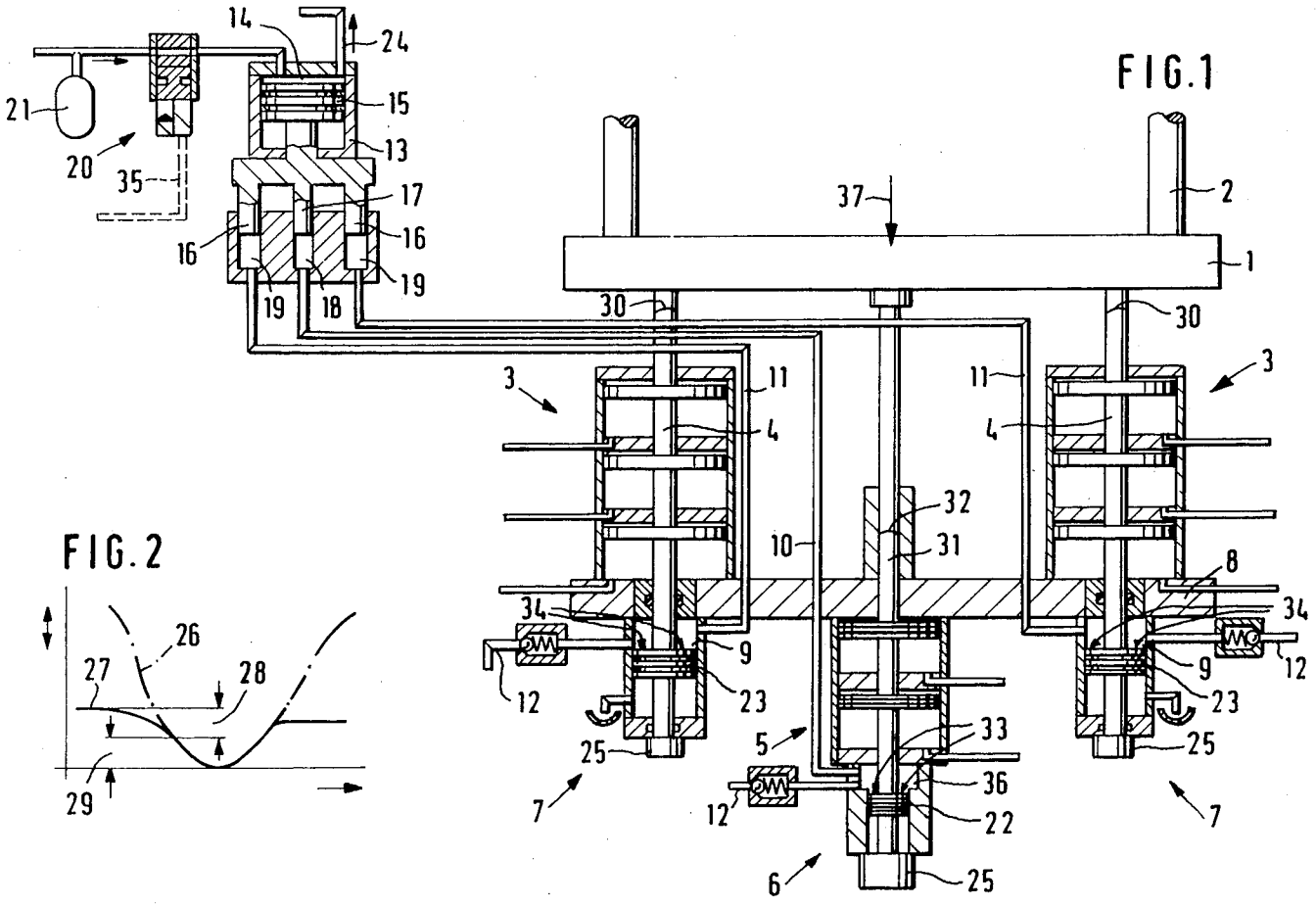
FIG. 1 is a somewhat schematic vertical cross-sectional view through the drawing, ejection and pre-acceleration mechanisms in accordance with the present invention.
FIG. 2 is a diagram of the drawing ram and sheet metal holder movement in accordance with the present invention.

Referring now to the drawing, the drawing installation in FIG. 1 includes a number of pressure cylinders generally designated by reference numeral 3 for the sheet metal retention and at least one pressure cylinder generally designated by reference numeral 5 for the ejection of the respectively deformed workpiece. The pressure cylinders 3 and 5 are retained by way of a bracket 8 which may be a part of the press table, and operate by way of their piston rods 4 and 31 from below on the pressure plate 1. The piston rods 4 are disengageable from the bottom side of the pressure plate 1 for the ejection operation. Ball sockets are indicated by reference numerals 30 and 32. Pressure rods 2 are shown above the pressure plate 1 which engage into the drawing tool on the press table and are placed against the sheet metal holder, respectively, an ejector element. The piston rods 4 and 31 are extended downwardly and reach up to into a respective additional further pressure cylinder generally designated by reference numerals 6 and 7. In view of the different pressure forces in the piston rods 31 and 4 which have to be produced during the drawing, the diameters of the pistons 22 and 23, taken along with the piston rods 31 and 4, are of different size if, for example, equal pressure conditions are to prevail in the pressure cylinders 6 and 7. A pressure space 36 and 9 is provided above each of the pressure pistons 22 and 23, during the pressure actuation of which the operating surface 33 and 34, properly speaking, of each piston 22 and 23 and therewith the piston rods 31 and 4 are displaced in the drawing direction 37. Abutments 25 delimit the movement of the piston rods 31 and 4 in the upward movement. The pressure space 36 above the piston 22 is in fluid communication, on the one hand, by way of a pressure line 10 with a pressure quantity space 18 in a pre-acceleration cylinder 13 fixed in the press. On the other hand, a refill line 12 extends into the pressure space 36, out of which hydraulic refill liquid can flow into the pressure space 36 during the occurring suction pressure. The pressure spaces 9 in the pressure cylinder 7 are in fluid communication, separate from one another, on the one hand, by way of pressure lines 11 with a respective pressure quantity space 19 in the pre-acceleration cylinder 13. On the other hand, one refill line 12 each extends into the pressure spaces 9, out of which hydraulic refill liquid can flow into the pressure spaces 9 with an occurring suction pressure. The refill flow of hydraulic liquid from a pressure reservoir into the pressure spaces 36 and 9 is established by way of a throttling directional control valve. The directional control valve which may be a so-called prop valve is controlled into the open-position in dependence on the position, respectively, movement of the drawing ram as disclosed in commonly assigned co-pending application Ser. No. 125,925.

Pressure or plunger pistons 16 and 17, which are rigidly connected with a pressure piston 15, immerse into the pressure quantity spaces 18 and 19. A pressure space 14 is coordinated to the pressure piston 15, to which hydraulic liquid under high pressure is supplied from a pressure reservoir 21 during shifting of a valve generally designated by reference numeral 20. The valve 20 is also a throttling directional control valve and the control takes place also, for example, from the press control by way of the control line 35 as a function of the position, respectively, movement of the drawing ram.

The control with respect to time of the directional control valve 20 in the pressure line to the pressure space 14 of the pre-acceleration cylinder 13 and of the directional control valve in the refill line 12 into the pressure spaces 36 and 9 will be explained by reference to FIG. 2. The movement characteristics of the drawing ram, plotted against angle of rotation, is shown by curve 26. During the working stroke of the drawing ram, the sheet metal holder is to be pre-accelerated in the drawing direction 37 (curve 27) together with the sheet metal part resting thereon and to be deformed into a workpiece by opening of the directional control valve 20 in the pressure line to the pressure space 14 in the pre-acceleration cylinder 13. As a result of the movement of the pressure pistons 16 and 17 in the pressure spaces 18 and 19, a predetermined quantity of hydraulic liquid is displaced by way of the pressure lines 10 and 11 into the pressure spaces 36 and 9 so that the pressure pistons 22 and 23 are accelerated in the drawing direction 37. The pre-acceleration phase 28 passes over into a suction phase 29 for the pressure spaces 36 and 9 when the drawing ram together with the drawing ring impinges on the sheet metal part. For that purpose, the directional control valves in the refill lines 12 to the pressure spaces 36 and 9 are to be opened. The suction phase in the pressure spaces 36 and 9 terminates with the reversal of the movement of the drawing ram and the controlled lift of the pressure plate 1.

In order to achieve an identical pre-acceleration of all piston rods 31 and 4, the diameters of the pistons 17 and 16 in the pressure quantity spaces 18 and 19 are to be selected at the ratio of the operating surfaces 33 and 34 on the pistons 22 and 23 in the pressure spaces 36 and 9. It is understood that for the use of other stroke and pressure conditions, the pressure pistons 16 and 17 can be displaced by separate pre-acceleration cylinders 13. This would be the case, for example, if for spatial reasons and for reasons of a low pressure specification, the acceleration of the sheet metal holder is to be attained.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A drawing installation for a press, comprising mechanically actuated drawing ram means, sheet metal holder means including pressure cylinder means for the sheet metal retention during the drawing operation and at least one pressure cylinder means for the ejection of the workpiece, pressure plate means movable in a press table by piston rods of the pressure cylinder means and the at least one pressure cylinder means, respectively and transmitting the movement and forces of the pressure cylinder means and the at least one pressure cylinder means by way of pressure rods onto the sheet metal holder means and for the ejection of the workpiece, each piston rod including a pressure piston having an operating surface adapted to be acted upon in a drawing direction, a pre-acceleration cylinder means having pressure quantity spaces, a pressure space, and a pressure piston separating the pressure quantity spaces from the pressure space, each pressure quantity space being in fluid communication with and coordinated to one of the operating surfaces and with control means operating in dependence on the ram travel for pressure-actuating the pressure space of said pre-acceleration cylinder means by way of a throttling directional control valve means so that prior to contact of the drawing ram means on the sheet metal holder means, the latter is operable to be pre-accelerated in the drawing direction by actuation of the operating surfaces with hydraulic liquid from the pressure quantity spaces.

2. A drawing installation according to claim 1, wherein each pressure quantity space coordinated to a respective operating surface has a further pressure piston axially movable within the pressure quantity spaces, each of the further pressure pistons being movable in unison by the pressure piston of the pre-acceleration cylinder means.

3. A drawing installation according to claim 2, wherein the pressure space in the pre-acceleration cylinder means is operable to be brought into fluid communication with a pressure source by way of the throttling directional control valve means, and wherein the directional control valve means is shiftable by the control means of the press operating in dependence on ram travel.

4. A drawing installation according to claim 3, wherein with the same stroke of the further pressure pistons in the pressure quantity spaces the diameter ratios of the further pressure pistons to one another correspond to the area ratios of the operating surfaces of the first-mentioned pressure pistons in the pressure cylinder means to one another.

5. A drawing installation according to claim 2, wherein with the same stroke of the further pressure pistons in the pressure quantity spaces the diameter ratios of the further pressure pistons to one another correspond to the area ratios of the operating surfaces of the first-mentioned pressure pistons in the pressure cylinder means to one another.

6. A drawing installation according to claim 1, wherein the pressure space in the pre-acceleration cylinder means is operable to be brought into fluid communication with a pressure source by way of the throttling directional control valve means, and wherein the directional control valve means is shiftable by the control means of the press operating in dependence on ram travel.

* * * * *